US005131897A

United States Patent [19]

Krieger

[11] Patent Number: 5,131,897

[45] Date of Patent: Jul. 21, 1992

[54] LEG PRESS ADAPTER PLATE KIT

[76] Inventor: Howard G. Krieger, 25 N. Belcher Rd., #I-139, Clearwater, Fla. 34625

[21] Appl. No.: 732,789

[22] Filed: Jul. 19, 1991

[51] Int. Cl.[5] ..... A63B 21/06

[52] U.S. Cl. ..... 482/93; 482/100; 482/137

[58] Field of Search ..... 272/96, 116, 117, 118, 272/119, 123, 134, 143, DIG. 4; D21/191

[56] References Cited

U.S. PATENT DOCUMENTS

| | | | |
|---|---|---|---|
| D. 297,957 | 10/1988 | Gordon, III | D21/191 |
| 3,000,632 | 9/1961 | Fucks | 272/134 X |
| 3,734,495 | 5/1973 | Nist et al. | 272/134 X |
| 3,743,282 | 7/1973 | Zinkin | 272/134 X |
| 3,820,782 | 6/1974 | Salkeld | 272/134 X |
| 3,917,262 | 11/1975 | Salkeld | 272/134 X |
| 4,149,714 | 4/1979 | Lambert, Jr. | 272/118 |
| 4,169,589 | 10/1979 | McArthur | 272/118 |

*Primary Examiner*—Robert Bahr
*Attorney, Agent, or Firm*—Leon Gilden

[57] ABSTRACT

A leg press machine includes resistant weights and a resistant plate movably mounted relative to the machine for effecting reciprocation of the plates, wherein an adapter plate organization includes a "C" shaped plate member positionable about the resistant plate permitting an enlarged support platform enabling an enlarged spacing between the feet members of an individual effecting displacement of the resistance plate. The invention includes "C" shaped cushion members selectively securable to a forward surface of the adapter plate member in a complementary manner, wherein a plurality of such cushion members are provided utilizing selective pneumatic or friction powder within a respective plurality of cushion members.

6 Claims, 4 Drawing Sheets

LEG PRESS ADAPTER PLATE KIT

BACKGROUND OF THE INVENTION

1. Field of the Invention

The field of invention relates to exercise apparatus, and more particularly pertains to a new and improved leg press adapter plate kit wherein the same is arranged for mounting to an existing resistant plate of an exercise machine resulting in an enlarged platform surface.

2. Description of the Prior Art

Exercise devices of various types are utilized throughout the prior art and known for use in combination with exercise of various body components. The instant invention attempts to overcome deficiencies of the prior art by providing an organization wherein the same is arranged for providing an enlarged surface for use with a resistance plate associated with an associated exercise device. Prior art devices are exemplified for example in U.S. Pat. No. 4,838,548 to Maag wherein a conventional resistance stack of plates is operative through an individual or plurality of levers, each including a support plate member.

U.S. Pat. Nos. 4,830,367; 4,854,578; 4,867,143; and 4,813,666 are examples of prior art resistance devices utilizing a displaceable plate member relative to a resistance weight.

As such, it may be appreciated that there continues to be a need for a new and improved leg press adapter plate kit as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of exercise apparatus now present in the prior art, the present invention provides a leg press adapter plate kit wherein the same is arranged for mounting an adapter plate onto a resistance plate of an exercise device for providing an enlarged resistance surface for use by an individual. As such, the general purpose of the present invention, which will be described subsequently in greater detail, is to provide a new and improved leg press adapter plate kit which has all the advantages of the prior art exercise apparatus and none of the disadvantages.

To attain this, the present invention provides a leg press machine including resistant weights and a resistant plate movably mounted relative to the machine for effecting reciprocation of the plates, wherein an adapter plate organization includes a "C" shaped plate member positionable about the resistant plate permitting an enlarged support platform enabling an enlarged spacing between the feet members of an individual effecting displacement of the resistance plate. The invention includes "C" shaped cushion members selectively securable to a forward surface of the adpater plate member in a complementary manner, wherein a plurality of such cushion members are provided utilizing selective pneumatic or friction powder within a respective plurality of cushion members.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follow may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved leg press adapter plate kit which has all the advantages of the prior art exercise apparatus and none of the disadvantages.

It is another object of the present invention to provide a new and improved leg press adapter plate kit which may be easily and efficiently manufactured and marketed.

It is a further object of the present invention to provide a new and improved leg press adapter plate kit which is of a durable and reliable construction.

An even further object of the present invention is to provide a new and improved leg press adapter plate kit which is susceptible of a low cost of manufacture with regard to both materials and labor, and which accordingly is then susceptible of low prices of sale to the consuming public, thereby making such leg press adapter plate kits economically available to the buying public.

Still yet another object of the present invention is to provide a new and improved leg press adapter plate kit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
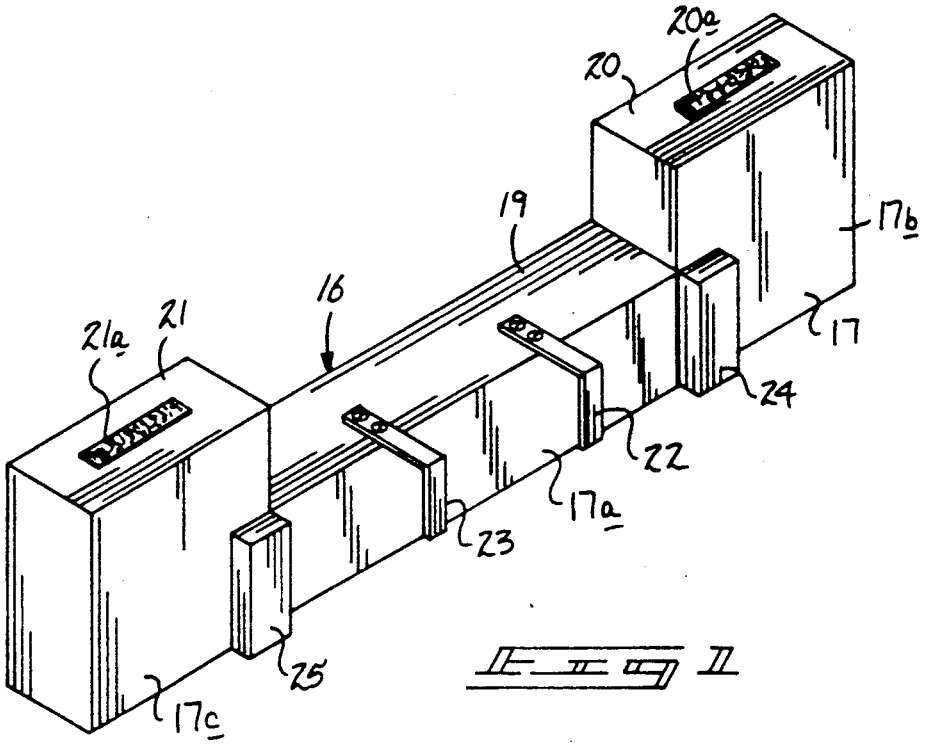
FIG. 1 is a rear isometric illustration of the adapter plate member utilized by the instant invention.

With reference now to the drawings, and in particular to FIGS. 1 to 7 thereof, a new and improved leg press adapter plate kit embodying the principles and concepts of the present invention and generally designated by the reference numeral 10 will be described.

Figure 2:
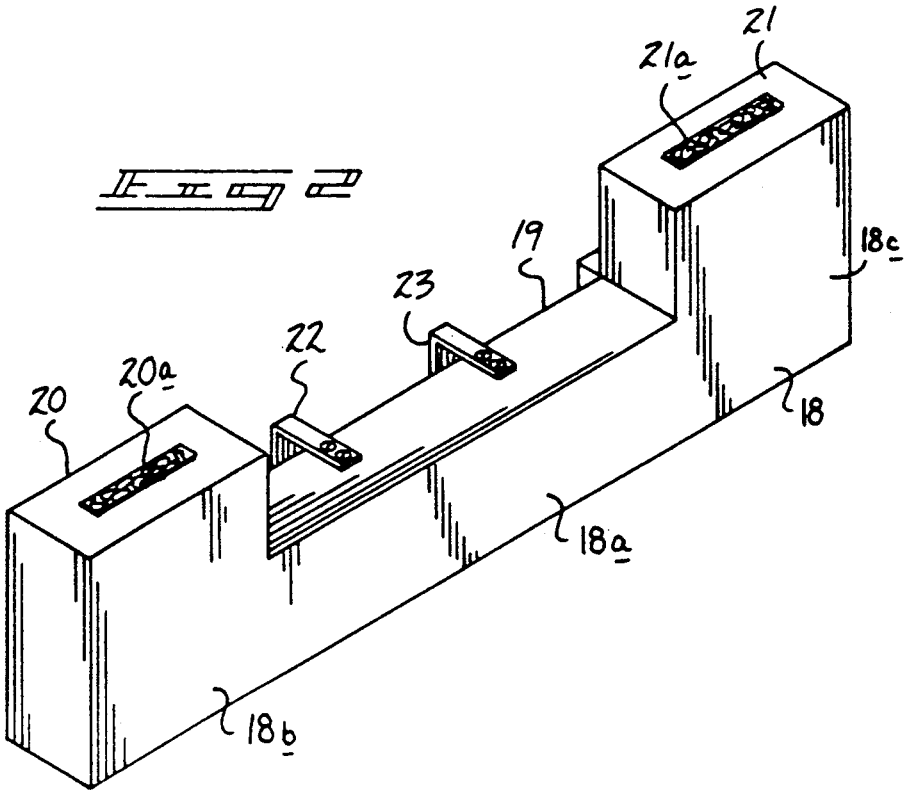
FIG. 2 is an isometric front view of the adapter plate member utilized by the instant invention.
Figure 3:
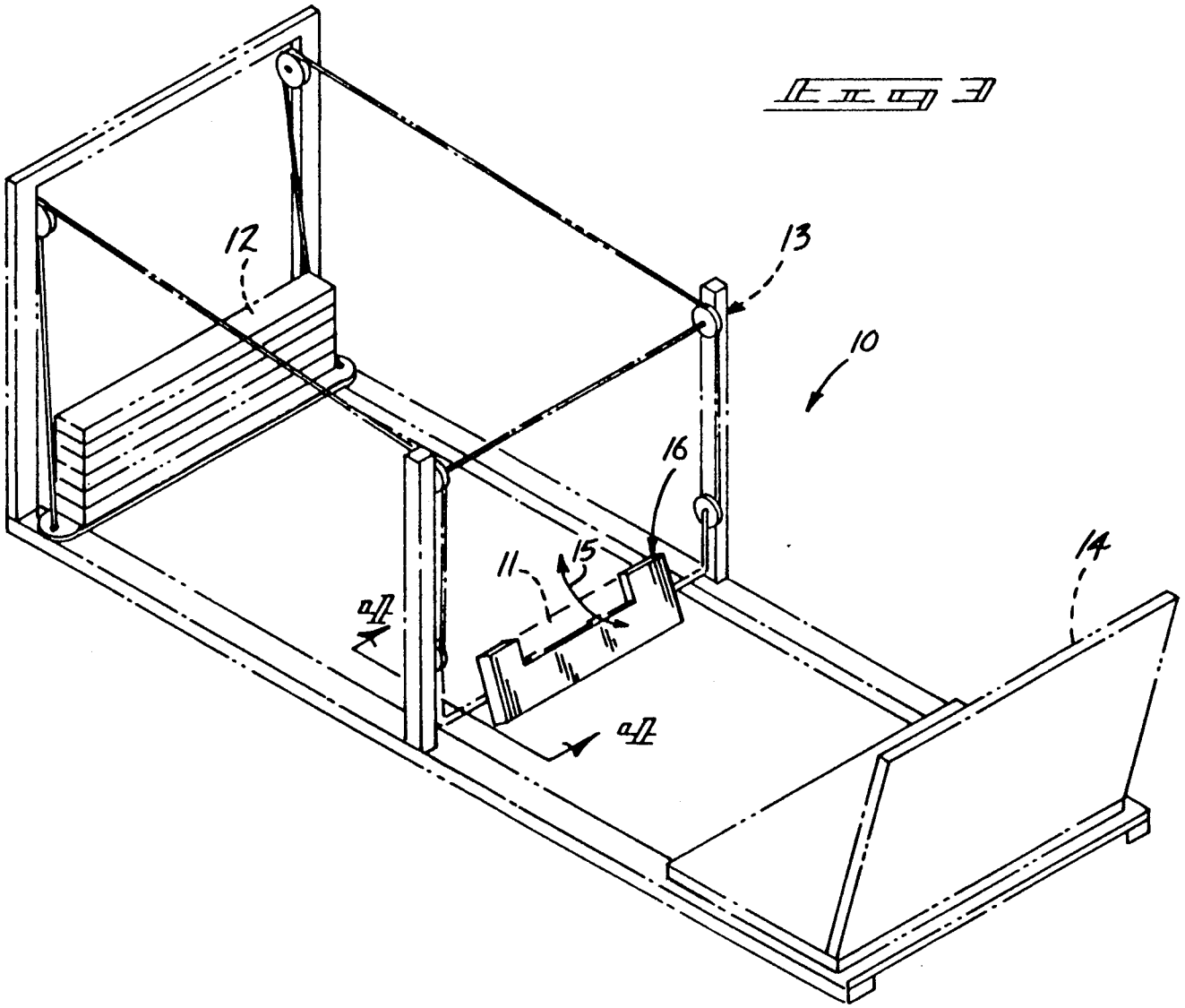
FIG. 3 is an isometric illustration of the plate kit in association with an exercise apparatus.

More specifically, the leg press adapter plate kit 10 of the instant invention essentially comprises the use of an adapter plate member 16, as illustrated in FIGS. 1 and 2 for example, in combination with a leg press machine 13, as presented with a "C" member 14 in confrontation to a resistance plate 11 that is arranged for displacement in the orientation of the directional arrow 15 for displacing in an adjustable manner a stack of resistance weights 12.

Figure 4:
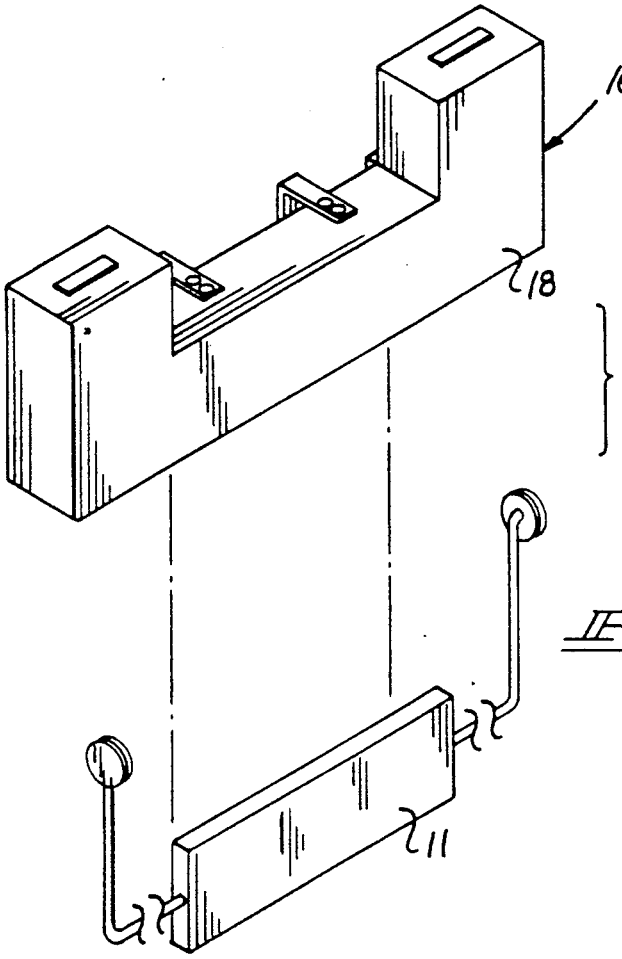
FIG. 4 is an isometric exploded illustration of the adapter plate member mounted to the associated resistance plate of the exercise apparatus.
Figure 5:
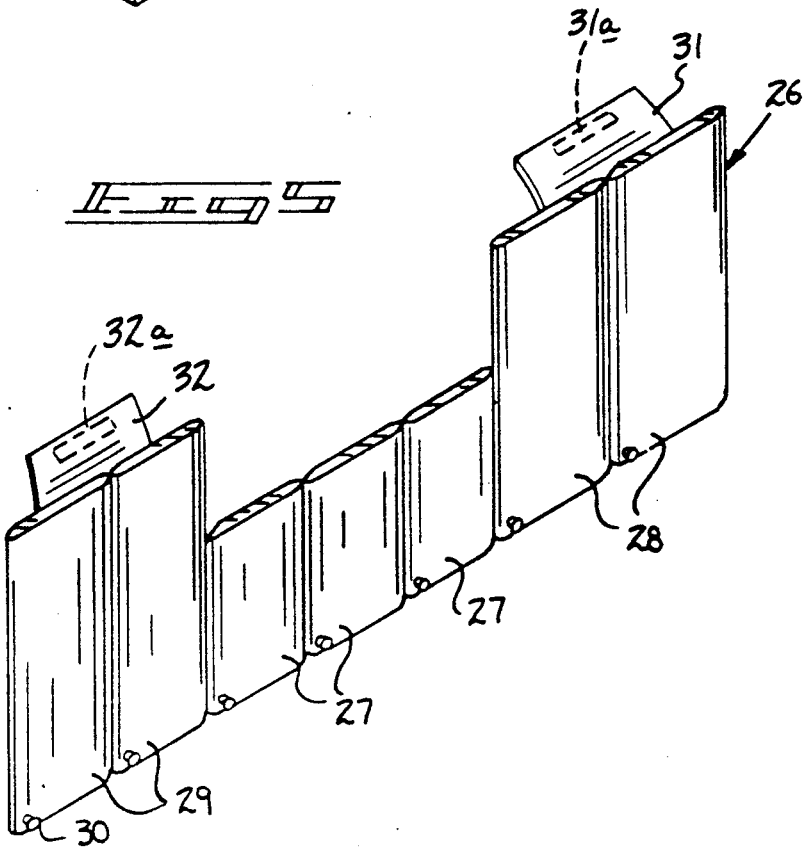
FIG. 5 is a first "C" shaped cushion member arranged for securement to the forward face of the adapter plate member.
Figure 6:
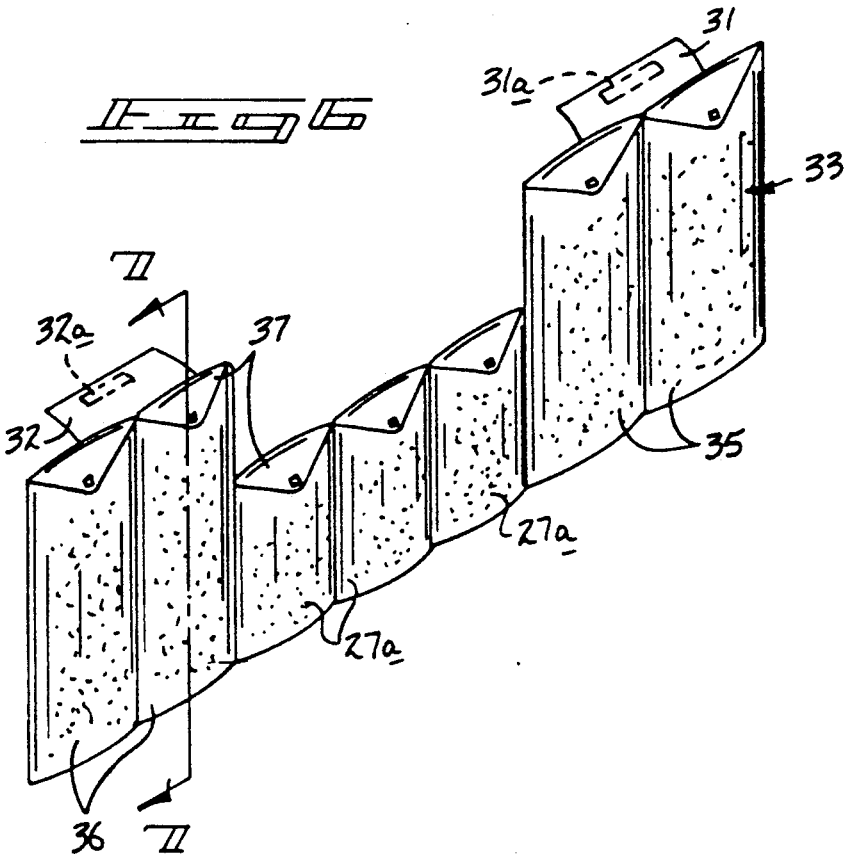
FIG. 6 is an isometric illustration of a second "C" shaped cushion member arranged for securement to the forward face of the adapter plate member.
Figure 7:
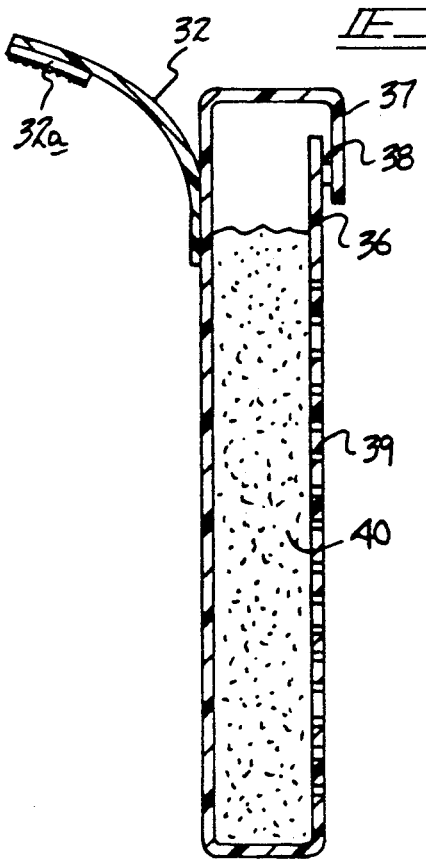
FIG. 7 is an orthographic view, taken along the lines 7—7 of FIG. 6 in the direction indicated by the arrows.

The adapter plate member 16 includes a "C" shaped planar rear face 17 spaced from and parallel a "C" shaped planar forward face 18. The planar rear face 17 includes a central rear surface 17*a*, with a respective right and left rear surface 17*b* and 17*c* positioned on opposite sides of the rear surface 17*a*, wherein the right and left rear surfaces 17*b* and 17*c* extend above the central rear surface 17*a* to define a "C" shaped configuration. The central rear surface 17*a* is terminated by a first top wall recessed below a respective right and left second top wall 20 and 21 respectively. The right and left second top walls 20 and 21 are coplanar relative to one another and parallel to a spaced relationship relative to the recessed first top wall 19. Respective right and left hook and loop first fastener strips 20*a* and 21*a* are mounted to respective right and left second top walls 20 and 21, for uses to be discussed in more detail below. A respective first and second "L" shaped bracket 22 and 23 are fixedly mounted in a spaced parallel relationship coextensive relative to one another to the first top wall 19 to define a gap between the first and second "L" shaped brackets 22 and 23 relative to the central planar rear surface 17*a* a predetermined width equal to a predetermined thickness defined by the resistance plate 11 to receive the resistance plate 11 between the first and second "L" shaped brackets 22 and 23 and the central rear surface 17*a*. First and second abutment blocks 24 and 25 are fixedly mounted to the respective right and left rear surfaces 17*b* and 17*c* adjacent and contiguous with the rear central surface 17*a* a predetermined spacing substantially equal to a predetermined length defined by the resistance plate 11 to position and align the resistance plate 11 relative to the adapter plate 16, in a manner as illustrated in FIG. 4 for example.

A first "C" shaped cushion member 26 is provided defined by adjacent parallel pneumatic bags, including a plurality of medially positioned pneumatic bags 27 positioned between respective left and right pneumatic bags 28 and 29 respectively. Each pneumatic bag includes an inflation valve 30 associated therewith. The "C" shaped first cushion member 26 is configured to be complementarily received to the planar forward face 18. A respective left and right flap 31 and 32 is mounted to the respective left and right pneumatic bags 28 and 29 at upper terminal ends thereof, wherein each of the left and right flaps include respective left and right second hook and loop fastener strips 31*a* and 32*a* for selective securement to the respective left and right hook and loop first fastener strips 21*a* and 20*a*.

A second "C" shaped cushion member 33 is provided, also of a complementary configuration to the planar forward face 18, including medial container bags 34 complementarily received upon the central planar surface 18*a*, and respective left and right container bags 35 and 36 complementarily received on respective left and right forward surfaces 18*c* and 18*b* respectively. Each of the bags includes a bag cover flap 37, including a flap connector 38 permitting securement of the respective flap 37 of each bag to an associated apertured forward bag wall 39. The apertured forward bag wall 39 permits a friction powder 40 (such as rosin powder) to be directed through the matrix of apertures through the forward wall to provide enhanced frictional association between an individual's feet and the bags during use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A leg press adapter plate kit, comprising in combination, a leg press machine including a seat member in spaced relationship relative to a resistance plate, the resistance plate defined by a predetermined thickness, a predetermined length, and a predetermined height, and an adapter plate member selectively securable to the resistance plate, the adapter plate member defined by a "C" shaped configuration including a planar rear "C" shaped face spaced from and parallel a planar forward "C" shaped face, the planar rear "C" shaped face including a central rear surface, the central rear surface defined by the predetermined length and the predetermined height, and wherein the planar "C" shaped rear surface includes a right rear surface and a left rear surface positioned on opposed ends of the central rear surface, and a first top wall oriented orthogonally and coextensive with the central rear surface, the first top wall including a first "L" shaped bracket spaced from and parallel a second "L" shaped bracket, wherein the first and second "L" shaped brackets are arranged coextensive relative to one another to define a spacing between a first portion of the first "L" shaped bracket and a first portion of the second "L" shaped bracket spaced from the central rear surface, wherein the spacing is substantially equal to the predetermined thickness of the resistance plate to position the resistance plate between the first and second "L" shaped brackets and the central rear surface.

2. A kit as set forth in claim 1 wherein the kit includes a first "C" shaped cushion member and a second "C" shaped cushion member, each cushion member defined by a complementary configuration to the "C" shaped planar forward face of the adapter plate member.

3. A kit as set forth in claim 2 including a left second top wall and a right second top wall orthogonally and coextensively mounted to an upper edge of the respective left and right rear surface, and the left second top wall includes a left hook and loop first fastener strip fixedly mounted thereon, and the right second top wall includes a right hook and loop first fastener strip mounted thereon, and the "C" shaped first cushion member includes a first cushion member left and right flap, wherein the first cushion member left and right flaps each respectively includes a respective left second hook and loop fastener strip selectively securable to the left hook and loop first fastener strip, and a right second hook and loop fastener strip selectively securable to the right hook and loop first fastener strip, and the "C" shaped second cushion member includes a second cushion member left flap and a second cushion member right flap, the second cushion members left and right flap include respective further left and right second hook and loop fastener strips selectively securable to the respective left and right hook and loop first fastener strips.

4. A kit as set forth in claim 3 including a first and second abutment block fixedly mounted to the respective right and left rear surface in contiguous adjacency to the central rear surface, wherein the first and second abutment blocks are spaced apart the predetermined length to position the resistance plate between the respective first and second abutment blocks.

5. A kit as set forth in claim 4 wherein the first "C" shaped cushion member includes spaced parallel pneumatic bags, each pneumatic bag includes an inflation valve to effect selective inflation of each pneumatic bag.

6. A kit as set forth in claim 5 wherein the "C" shaped second cushion member includes a plurality of spaced parallel container bags, each container bag includes a bag cover flap, and each bag cover flap including a flap connector, and each bag including an apertured forward bag wall, and each respective flap connector is selectively securable to an associated apertured bag forward wall, and each of the container bags includes a predetermined quantity of a friction powder container therewithin, the friction powder in communication with a matrix of apertures defined by the apertured forward bag wall to permit directing of the friction powder through the apertured forward bag wall.

* * * * *